United States Patent [19]

Choinski

[11] 4,143,190

[45] Mar. 6, 1979

[54] METHOD AND APPARATUS FOR COATING WEBS

[75] Inventor: Edward J. Choinski, Wayland, Mass.

[73] Assignee: Polaroid Corporation, Cambridge, Mass.

[21] Appl. No.: 763,059

[22] Filed: Jan. 27, 1977

[51] Int. Cl.[2] ..... B05D 1/30

[52] U.S. Cl. ..... 427/420; 96/87 R; 118/410; 118/411; 118/412

[58] Field of Search ..... 118/50, 412, 407, 410, 118/411; 427/420; 96/87 R

[56] References Cited

U.S. PATENT DOCUMENTS

| | | | |
|---|---|---|---|
| 2,761,417 | 9/1956 | Russell et al. | 118/412 X |
| 2,761,419 | 9/1956 | Mercier et al. | 118/412 |
| 3,005,440 | 10/1961 | Paddy | 156/243 X |
| 3,220,877 | 11/1965 | Johnson | 118/412 X |
| 3,474,758 | 10/1969 | Russell | 118/412 X |
| 3,627,564 | 12/1971 | Mercier | 118/412 X |
| 3,893,410 | 7/1975 | Herzhoff | 118/412 |
| 3,903,843 | 9/1975 | Jones | 118/412 |
| 3,920,862 | 11/1975 | Damschroder et al. | 118/420 X |
| 3,928,678 | 12/1975 | Jackson | 118/411 X |
| 3,928,679 | 12/1975 | Jackson et al. | 118/411 |
| 3,958,532 | 5/1976 | Timson | 118/412 |
| 3,973,062 | 8/1976 | Fahrni | 118/412 X |

*Primary Examiner*—Shrive P. Beck
*Attorney, Agent, or Firm*—John W. Ericson

[57] ABSTRACT

Method and apparatus for coating a moving web with a multilayer liquid composition. The liquid composition is flowed by gravity down a plurality of slides each having a concave, inclined surface and having slots for feeding each layer onto the inclined surface. The inclined surface can be wholly or partially concave wherein the concave portion extends across the width of the slide.

10 Claims, 3 Drawing Figures

METHOD AND APPARATUS FOR COATING WEBS

BACKGROUND OF THE INVENTION

This invention relates to a method and apparatus for coating a moving web with a plurality of coatings and more particularly to a method and apparatus for coating a moving web with a multilayer liquid composition which is subsequently set or gelled on the web.

Presently, there is available coating apparatus for applying a plurality of superimposed layers to a moving web. Typical apparatus utilizes a plurality of inclined slide surfaces separated by exit slots through each of which is metered a coating solution onto an adjacent inclined surface. The coating solutions flow by gravity over the inclined surfaces and those metered through upstream slots flow over coating solutions metered through downstream slots and form a multilayered stream formed of the individual coating solutions that cascade over the downstream inclined surfaces. As the coating solutions flow under gravity over the inclined surfaces, each layer becomes smooth and is of uniform thickness. At the last inclined surface or slide, the multilayered stream is stratified in a configuration which constitutes the desired multilayered coating to be contacted with the moving web. The end of the last slide is spaced apart from the moving web so that the multilayered stream exiting the last slide toward the web forms a bead or bridge between the last slide and the moving web. A pressure differential generally is effected across the bead by applying a vacuum to the bottom surface of the bead immediately adjacent the top surface of the web to stabilize the bead against excessive vibration and rupture. As the web contacts the bead, it entrains the multilayered coating, thereby becoming coated.

Coating apparatus of the kind described is useful, for example, to form webs coated with superimposed layers of aqueous photographic compositions including light sensitive materials, chemical sensitizers, antifoggants, developing agents and the like. These compositions are mixed with synthetic or naturally occurring colloids such as gelatin, polyvinyl compounds, or the like, which form nonflowing set layers containing the photographic compositions when the colloid is dried on the web.

Typical of the apparatus described above are set forth in U.S. Pat. Nos. 2,761,419 and 3,220,877. In the apparatus disclosed in U.S. Pat. Nos. 2,761,419 and 3,220,877, the slides are planar and the angle between the planar surface of the last slide and the tangent to the web at the point of coating contact is acute. When coating a web with such apparatus, the feed slots between the slides sometimes become partially blocked with solid impurities. When this occurs, the liquid composition emanating from the slot is disrupted and forms a noncontinuous layer on the slide which is not self-correcting as the layer flows down the slide. When this occurs, the liquid layer immediately above the disrupted layer fills the discontinuity formed by the blockage and the resultant coating on the web is undesirably streaked and photographic film formed from the thus-coated web is unacceptable.

It would be desirable to provide a coating apparatus which assures forming continuous layers within a multilayer liquid composition even when the feeding slots for the liquid become partially blocked.

SUMMARY OF THE INVENTION

In accordance with this invention, a coating method and apparatus are provided wherein a plurality of liquid compositions are metered each through one of a plurality of discharge slots and flowed by gravity as a multilayer liquid to a moving web to be coated by the multilayer liquid. Each slide has a concave surface shaped as a smooth curve (or formed by two intersecting planes) which extends from the upstream discharge slot associated with the slide. The concave surface can extend all or a portion of the length of each slide and extends the width of the slide corresponding to the width of the desired coating on the moving web. The cascading multilayer liquid composition forms a multilayer pool on each slide so that irregularities in an individual liquid strata can be smoothed out during the residence time in the pool and the desired multilayer configuration is maintained.

DESCRIPTION OF THE SPECIFIC EMBODIMENTS

Figure 1:
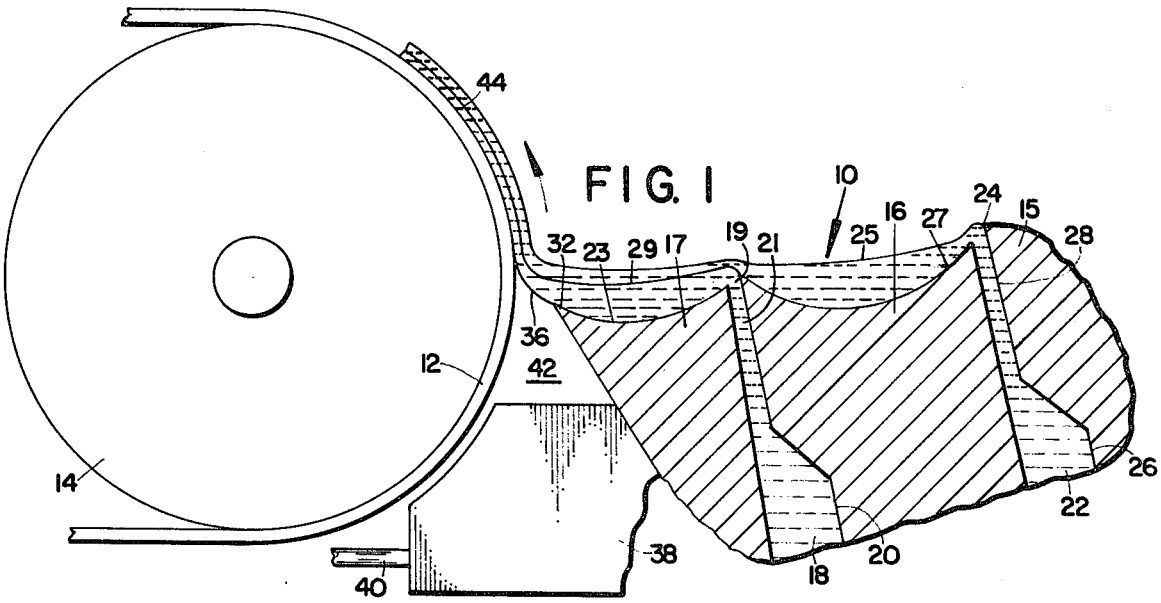
FIG. 1 is a side cross-sectional view of the multiple slide apparatus of this invention.

Referring to FIG. 1, the coating apparatus 10 is positioned adjacent a web 12 supported by a driven roller 14. The coating apparatus includes a plurality of slides 15, 16 and 17. The coating apparatus 10 is shown in operation for applying a two-layered liquid coating for illustrative purposes. It is to be understood that the liquid can comprise one or more layers if desired. Liquid composition 18 is extruded through slot 19 between slides 16 and 17 by a conventional metering pump (not shown) which pumps liquid 18 into reservoir 20, through channel 21 and through slot 19. Liquid composition 22 also is extruded through slot 24 between slides 15 and 16 by a conventional metering pump (not shown) which pumps liquid 22 into reservoir 26, through channel 28 and through slot 24. The slots 19 and 24 extend a lateral dimension between the slides which is generally coextensive with the lateral dimension of the web 12. The web 12 is formed of any suitable flexible material such as paper, plastic or metal and may be coated prior to being coated in accordance with this invention. The liquid compositions 18 and 22 exit the respective slots 19 and 24 onto slides 16 and 17. Liquid composition 18 flows by gravity down slide 17 and forms a pool 29 on the concave surface 23 which has a greater height than the height of the liquid 18 entering and exiting from slide 17. Liquid composition 22 flows by gravity down slide 16 and similarly forms a pool 25 on concave surface 27. At slot 19, liquid composition 22 overflows liquid composition 18 to form a two-layered liquid wherein little or no intermixing of the layers occurs.

A two-layered liquid bead 36 is formed between the slide edge 32 and the web 12 and the bead is stabilized by a vacuum generated by vacuum chamber 38 which is connected to a vacuum pump (not shown) by conduit 40 to exhaust air from chamber 42.

As the web 12 advances with the roller 14 past bead 36, it picks up the two-layered liquid to form a coated layer 44 of the two liquids on web 12. The layer 44 is dried in any conventional manner downstream of the roller 44.

Figure 2:
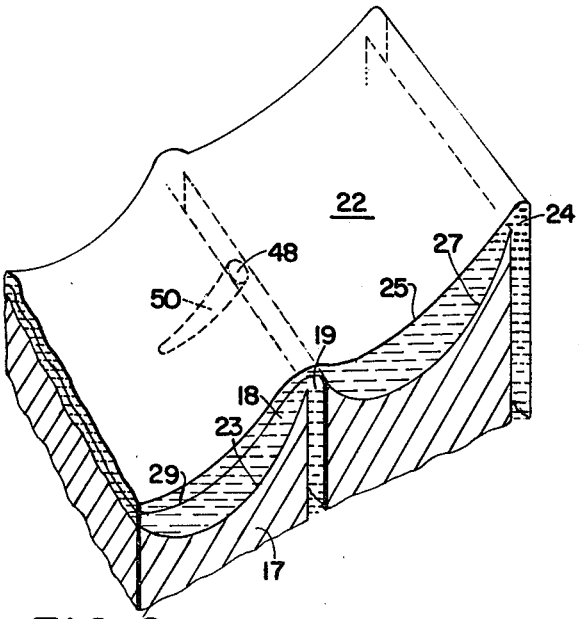
FIG. 2 is a top view of a portion of the apparatus of FIG. 1.

The self-healing effect on a disrupted liquid layer obtained with this invention will be described with reference to FIG. 2. Should the slot 19 become partially blocked with a solid particle 48, as shown, the area 50 adjacent the particle 48 will be deprived of the liquid 18. The area 50 then will be filled in by the liquid 22 located above the layer of liquid 18. However, as the layers 18 and 22 reach the bottom of the concave surface 23, their flow rates are reduced and the layer 18 will have a greater height. This increase in height will permit lateral flow of layer 18 due to gravity and it will fill in the area 50 and the liquid 22 in the area 50 will be forced upwardly into the liquid layer 22. By providing the concave surfaces 23 and 27, the undesirable streaking previously encountered when the discharge slots are blocked, is eliminated. Accordingly, the method and apparatus of this invention provides substantial advantages over the coating procedures of the prior art.

Figure 3:
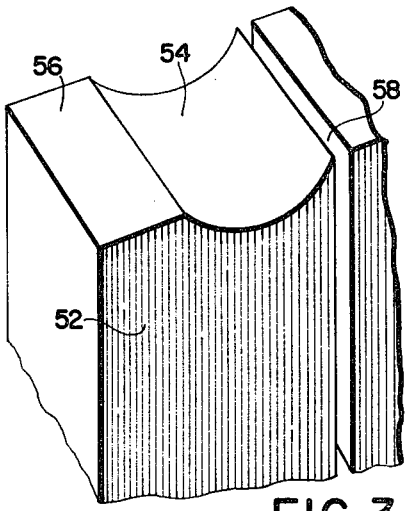
FIG. 3 is a top persepctive view of an alternative slide construction of this invention.

An alternative embodiment of the slide utilized in this invention is shown in FIG. 3. The top surface of the slide 52 comprises a concave surface 54 and a flat planar surface 56. The concave surface 54 is positioned adjacent the upstream discharge slot 58 so that a healing of discontinuities in the liquid layer occurs quickly after formation of the discontinuity.

The degree of concavity, which determines the height of the liquid pool that forms on the slide surface, is such that for a given flow rate of liquid, the residence time of the liquid in the pool is sufficient to allow lateral flow of the liquid to heal a discontinuity. Increased concavity permits increased flow rates.

The slide configuration shown in FIG. 3 can be used for any number of the slides in the coating apparatus. However, it is preferred that the last slide immediately adjacent the moving web not include the planar surface so that the multilayer liquid composition entering the bead between the moving web and the last slide is moving in generally the same upward direction as the moving web.

It is to be understood that this invention is not limited to the embodiments specifically described but includes modifications which will be evident to the person skilled in the art.

What is claimed is:

1. The method for coating a moving web with a liquid composition comprising a plurality of liquid layers wherein layers within said composition are separate and distinct which comprises:

a. flowing said liquid composition by gravity along a plurality of inclined slides in an adjacent inclined sequence producing one continuous slide surface over which said composition flows from slide to slide, said slides each comprising an inclined concave surface and each having a slot for feeding one of said liquid layers onto said inclined concave surface and to form a pool of said liquid on said inclined concave surface that has a depth greater than the depth of the liquid entering and exiting from said concave surface, and b. flowing said liquid composition across a gap between a slide immediately adjacent said moving web and said moving web to contact and coat said moving web.

2. The method of claim 1 wherein said liquid composition is flowed over a plurality of slides having an inclined surface which is entirely curved.

3. The method of claim 1 wherein said liquid is flowed over a plurality of slides which is partially curved and partially planar wherein said curved portion is positioned adjacent an upstream discharge slot.

4. The method of claim 1 wherein said liquid composition is flowed over a plurality of slides having a concave surface formed by two intersecting planar surfaces.

5. The method of claim 1 including the step of establishing a pressure differential across the liquid composition in said gap wherein the lowermost layer is exposed to a lower pressure.

6. Apparatus for coating a moving web with a liquid composition comprising a plurality of liquid layers wherein layers within said composition are separate and distinct comprising in combination:

a. means for flowing said liquid composition through slots and down a plurality of slides each following a different one of said slots and each having an inclined surface, said slides being in an adjacent inclined sequence and together forming one continuous inclined surface over which said composition flows from slide to slide;

b. at least a portion of each said inclined surface being concave which concave surface portion extends across the width of the slide to an extent corresponding to the width of the desired width of liquid composition on said web, said concave surface portion forming a pool of the liquid flowing down the slide that has a depth greater than the depth of the liquid entering and exiting said concave surface portion, and c. a lowermost of said slides being spaced by a gap from said moving web so that said liquid composition flows across said gap to contact and coat said web.

7. The apparatus of claim 6 wherein the surface of at least one of said slides is entirely curved.

8. The apparatus of claim 6 wherein the surface of at least one of said slides is partially curved and partially planar wherein said curved portion is positioned adjacent an upstream discharge slot.

9. The apparatus of claim 6 including means for establishing a pressure differential across the liquid composition in said gap wherein the lowermost layer is exposed to a lower pressure.

10. The apparatus of claim 6 wherein the concave surface of at least one of said slides is formed by two intersecting planar surfaces.

* * * * *